US008296865B2

(12) United States Patent
Garcia

(10) Patent No.: US 8,296,865 B2
(45) Date of Patent: Oct. 30, 2012

(54) APPARATUS FOR STIFFENING A SHIRT COLLAR

(76) Inventor: Jorge Carlos Gutierrez Garcia, Parkland, FL (US)

( * ) Notice: Subject to any disclaimer, the term of this patent is extended or adjusted under 35 U.S.C. 154(b) by 218 days.

(21) Appl. No.: 12/843,879

(22) Filed: Jul. 27, 2010

(65) Prior Publication Data

US 2012/0023640 A1 Feb. 2, 2012

(51) Int. Cl.
*A41B 3/00* (2006.01)

(52) U.S. Cl. ..... 2/132; 2/117; 223/83; 223/84

(58) Field of Classification Search ..... 2/116, 132, 2/117, 255–260, 263, 264; 223/66, 71, 81, 223/83, 84

See application file for complete search history.

(56) References Cited

U.S. PATENT DOCUMENTS

| | | | | | |
|---|---|---|---|---|---|
| 440,027 | A | * | 11/1890 | Gibble | 2/132 |
| 443,023 | A | | 12/1890 | Weir | |
| 454,201 | A | * | 6/1891 | Bowyer | 2/60 |
| 655,272 | A | * | 8/1900 | Pine | 2/132 |
| 892,604 | A | * | 7/1908 | Meehan | 2/132 |
| 962,665 | A | * | 6/1910 | Quigley | 2/131 |
| D44,319 | S | * | 7/1913 | Murphy | D2/609 |
| D44,545 | S | | 8/1913 | Robbins | |
| 1,233,860 | A | * | 7/1917 | Finkelstein | 2/131 |
| 1,235,454 | A | * | 7/1917 | Finkelstein | 2/132 |
| 1,413,470 | A | * | 4/1922 | Getsinger | 2/131 |
| 1,826,176 | A | * | 10/1931 | Hutchison | 2/132 |
| 1,929,236 | A | | 10/1933 | Bridler | |
| 2,019,053 | A | | 10/1935 | Manne | |
| 2,089,748 | A | * | 8/1937 | Herscovitch | 2/132 |
| 2,505,679 | A | * | 4/1950 | Less et al. | 2/132 |
| 2,510,030 | A | * | 5/1950 | Carlisle, Jr. | 2/132 |
| 2,659,892 | A | * | 11/1953 | Sharp et al. | 2/132 |
| 2,692,385 | A | * | 10/1954 | Harper | 2/93 |
| 2,724,836 | A | * | 11/1955 | Wiedemer | 2/132 |
| 2,744,255 | A | * | 5/1956 | Portias | 2/132 |
| 3,060,447 | A | * | 10/1962 | Dethier | 2/132 |
| 3,088,117 | A | * | 5/1963 | Baker | 2/129 |
| 3,565,301 | A | * | 2/1971 | Mosser et al. | 223/83 |
| 4,202,054 | A | * | 5/1980 | Siragusa | 2/116 |
| 4,922,553 | A | * | 5/1990 | Morrone | 2/132 |
| D309,586 | S | | 7/1990 | Ruscitti | |
| 4,967,420 | A | * | 11/1990 | Johnson | 2/116 |
| D321,485 | S | | 11/1991 | Bulgari | |
| 5,575,410 | A | * | 11/1996 | Compton | 223/84 |
| D393,224 | S | | 4/1998 | Miller | |
| 6,089,422 | A | * | 7/2000 | Gibson | 223/84 |
| D442,508 | S | | 5/2001 | Torres | |
| D457,087 | S | | 5/2002 | Torres | |
| 6,780,080 | B2 | * | 8/2004 | Horta et al. | 450/41 |
| 7,653,950 | B2 | * | 2/2010 | Johnson | 2/232 |
| 2005/0066425 | A1 | * | 3/2005 | Kozlarek | 2/256 |
| 2007/0277293 | A1 | * | 12/2007 | Koepp | 2/256 |
| 2007/0298683 | A1 | * | 12/2007 | Shaffstall | 450/86 |
| 2008/0047984 | A1 | * | 2/2008 | Keeter | 223/83 |

* cited by examiner

*Primary Examiner* — Khoa Huynh
*Assistant Examiner* — Andrew W Collins
(74) *Attorney, Agent, or Firm* — Mark Terry

(57) ABSTRACT

An apparatus for stiffening the folded collar of a dress or collared shirt is provided. A collared shirt includes a placket and a folded collar including an interior fold. The apparatus includes a circular, semi-rigid element for surrounding the interior fold of the folded collar, wherein the semi-rigid element is coextensive with the folded collar and includes a gap located at a placket of the shirt. The apparatus further includes a first elongated element that projects downwards at an acute angle from a left side of the semi-rigid element such that a tip of the first elongated element contacts a left shoulder of the shirt. The apparatus further includes a second elongated element that projects downwards at an acute angle from a right side of the semi-rigid element such that a tip of the second elongated element contacts a right shoulder of the shirt, wherein the semi-rigid element and the first and second elongated elements are integrally formed of a single piece of material.

16 Claims, 3 Drawing Sheets

APPARATUS FOR STIFFENING A SHIRT COLLAR

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of personal devices, and more particularly relates to the field of personal devices related to clothing for an individual.

BACKGROUND OF THE INVENTION

A shirt collar comprises a piece of fabric that extends upwards from the shirt and then folds over to extend downwards towards the wearer's shoulders and back. When properly worn, a shirt collar exhibits qualities of sophistication and orderliness. In order to keep its proper shape, a shirt collar must possess some stiffness, thereby providing structural stabilization to the portion of the collar that extends upwards. For various reasons, collars can lose their stabilization and thereby lose their proper shape. The shirt collar may be wet, wrinkled or worn out, resulting in a drab or misshapen collar. This leads to an unacceptable appearance that is undesirable for users of collared shirts. There are currently no good solutions to this problem.

Therefore, a need exists to overcome the problems with the prior art as discussed above, and particularly for a more efficient system for stiffening a shirt collar.

SUMMARY OF THE INVENTION

Briefly, according to an embodiment of the present invention, an apparatus for stiffening the folded collar of a dress or collared shirt is provided. A collared shirt includes a placket and a folded collar including an interior fold. The apparatus includes a circular, semi-rigid element for surrounding the interior fold of the folded collar, wherein the semi-rigid element is coextensive with the folded collar and includes a gap located at a placket of the shirt. The apparatus further includes a first elongated element that projects downwards at an acute angle from a left side of the semi-rigid element such that a tip of the first elongated element contacts a left shoulder of the shirt. The apparatus further includes a second elongated element that projects downwards at an acute angle from a right side of the semi-rigid element such that a tip of the second elongated element contacts a right shoulder of the shirt, wherein the semi-rigid element and the first and second elongated elements are integrally formed of a single piece of material.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
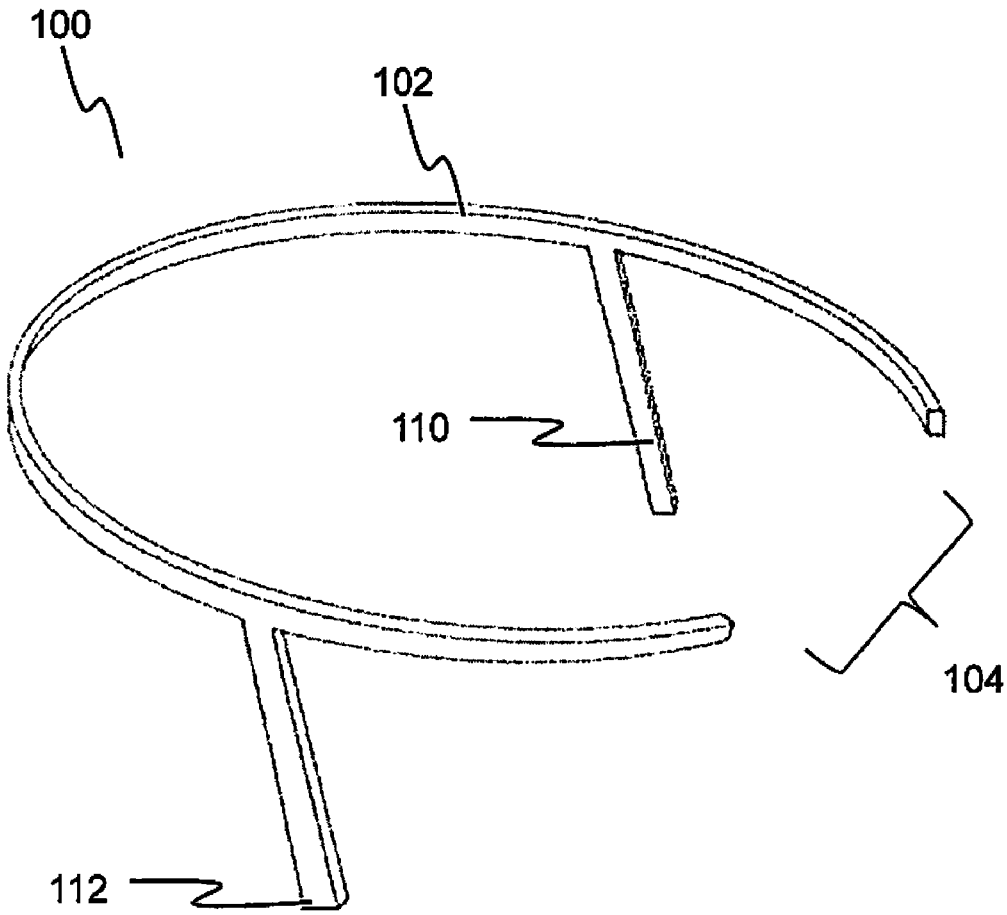
FIG. 1 is an illustration of a perspective view of the apparatus for stiffening a shirt collar, in accordance with one embodiment of the present invention.

FIG. 1 is an illustration of a perspective view of the apparatus 100 for stiffening a shirt collar, in accordance with one embodiment of the present invention. The apparatus 100 includes a circular element 102 having a substantially circular or oval shape and including a gap 104 in its circumference along its frontal side. The circular element 102 comprises a semi-rigid material, such as plastic, metal, alloy or the like. The material that comprises circular element 102 is semi-rigid in that it provides limited flexibility. In one embodiment, the circular element 102 provides only enough flexibility to allow the gap 104 to be manually opened just enough to allow placement of the element 102 around a shirt collar.

FIG. 1 further shows a first elongated element 110 that projects downward and forward at an acute angle from a left side of the circular element 102 and a second elongated element 112 that projects downward and forward at an acute angle from a right side of the circular element 102.

First and second elongated elements 110, 112 may be formed together with the circular element 102, so as to be structurally integrated with circular element 102. For example, the first and second elongated elements 110, 112 may be injection-molded together with the circular element 102. Alternatively, first and second elongated elements 110, 112 may be coupled with the circular element 102 after formation.

In one embodiment of the present invention, the exterior surface of first and second elongated elements 110, 112 and/or circular element 102 is covered in a rubber composite membrane. This membrane provides the exterior surface of first and second elongated elements 110, 112 and/or circular element 102 with a tacky or texturized quality that aids in keeping the apparatus 100 in place when located within the fold of a shirt collar. The rubber coating may comprise one continuous, uninterrupted membrane that covers the entire exterior surface of first and second elongated elements 110, 112 and/or circular element 102.

In another embodiment of the present invention, the apparatus 100 includes a rubber tip that covers the tips or endpoints or circular element 102 and/or the tips or endpoints of first and second elongated elements 110, 112. The rubber tips may comprise a strip that is wrapped around a tip or endpoint. The rubber tips serve to provide a bulbous element that cushions the tips of circular element 102 and/or first and second elongated elements 110, 112 so as to eliminate or reduce poking or jabbing of the wearer by apparatus 100.

Lastly, although FIG. 1 shows the elements 102, 110 and 112 to have a square-shaped or rectangular-shaped cross section, elements 102, 110 and 112 may have a cross section that is circular, oval, pentagonal, or the like.

Figure 2:
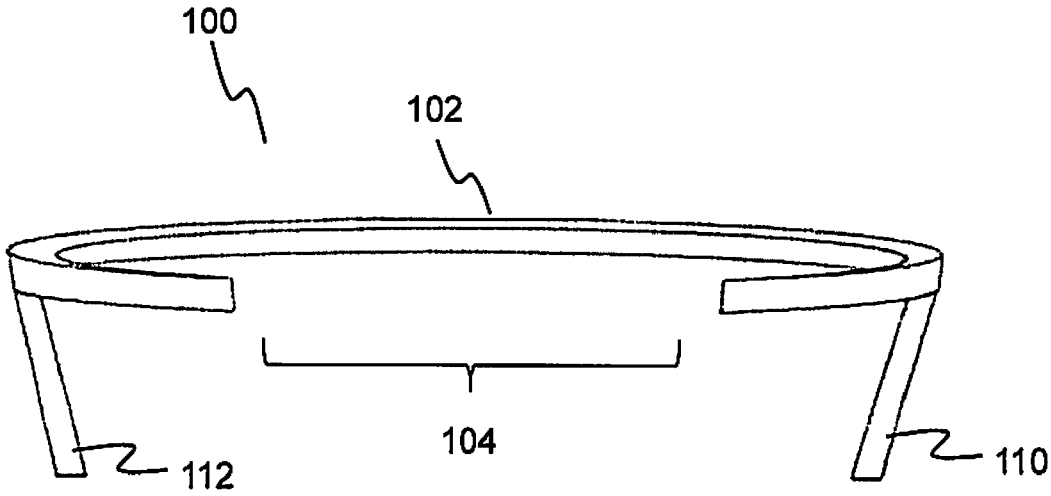
FIG. 2 is an illustration of a frontal perspective view of the apparatus for stiffening a shirt collar of FIG. 1.

FIG. 2 is an illustration of a frontal perspective view of the apparatus 100 for stiffening a shirt collar of FIG. 1. FIG. 2 shows apparatus 100 includes a circular element 102 having a substantially circular or oval shape and including a gap 104 in its circumference along its frontal side. FIG. 2 further shows first elongated element 110 that projects downwards at an acute angle from a left side of the circular element 102 and second elongated element 112 that projects downward at an acute angle from a right side of the circular element 102. FIG. 2 further shows first elongated element 110 projects slightly inwards towards a neck of the wearer of apparatus 100. Likewise, second elongated element 112 projects slightly inwards towards a neck of the wearer.

Figure 3:
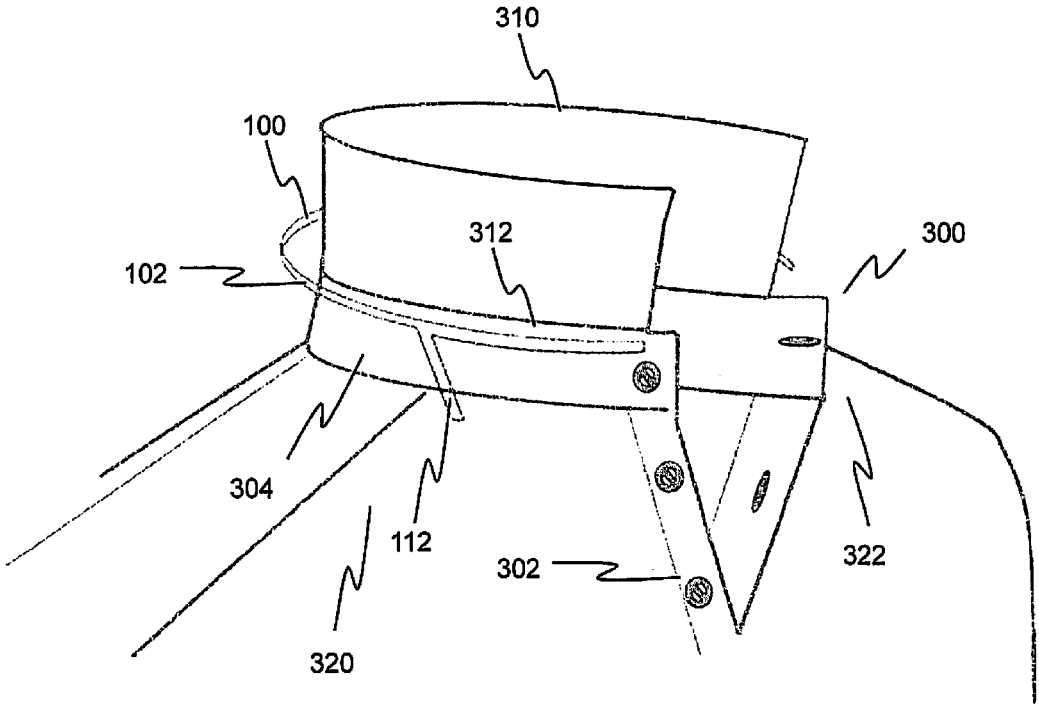
FIG. 3 is an illustration of a perspective view of the apparatus for stiffening a shirt collar of FIG. 1 in use on a collared shirt.

FIG. 3 is an illustration of a perspective view of the apparatus 100 for stiffening a shirt collar 310 of FIG. 1 in use on a collared shirt 300. FIG. 3 shows that shirt 300 includes a left shoulder area 322, which comprises an area of fabric of the shirt 300 that covers the left shoulder of the wearer. FIG. 3 also shows that shirt 300 includes a right shoulder area 320 which comprises an area of fabric of the shirt 300 that covers the right shoulder of the wearer.

Also shown in FIG. 3 is placket 302 of shirt 300, the placket comprising two strips that button together via a series of buttons and corresponding orifices. Shirt 300 also includes a collar strip 304 comprising a strip that surrounds the opening in the shirt 300 for the wearer's head. FIG. 3 also shows folding collar 310 connected at seam 312 to collar strip 304. The folding collar 310 is shown in FIG. 3 to be unfolded or "turned up" for exemplary purposes only.

FIG. 3 shows that apparatus 100 includes a circular element 102 having a substantially circular or oval shape, the circular element being placed around the collar strip 304 and, more specifically, along the seam 312. Circular element 102 includes a gap 104 in its circumference along the area of the placket 302, such that the circular element 102 does not overlap or obscure the placket 302.

FIG. 3 further shows second elongated element 112 that projects downward and forward at an acute angle from a right side of the circular element 102 such that the tip of the element 112 contacts the shoulder area 320 of the shirt 300. Also, first elongated element 110 (not shown) projects downward and forward at an acute angle from a left side of the circular element 102 and contacts the shoulder area 322 of the shirt 300.

Once placed in the correct position as per FIG. 3, the apparatus 100 is covered by folding down folding collar 310 at seam 312. This hides the apparatus 100 under the folding collar 310, thereby allowing for discrete use of the apparatus 100 without disclosing to a passerby that a device is being used to support the appearance of collar 310. The placement of apparatus 100 underneath the folding collar 310 provides structural support for the collar 310, thereby keeping the collar 310 upright and in the proper position. In one embodiment of the present invention, the U-shaped circular element 102 provides a clamping effect on the collar strip 304, thereby holding the apparatus 100 firmly in place along the entire seam 312 but hidden behind collar 310. A rubber exterior of apparatus 100 further provides friction between the apparatus 100 and collar 310 so as to hold the apparatus 100 in place.

As shown in FIG. 1, the first and second elongated elements 110, 112 hold the collar 310 up or in the upwards direction. Ideally, the height of first and second elongated elements 110, 112 is the same as the height of collar strip 304. In one embodiment of the present invention, in cases where the height of first and second elongated elements 110, 112 is not the same as the height of collar strip 304, the angle of the first and second elongated elements 110, 112 can be adjusted to have the same as the height of collar strip 304. That is, the acute angle between the first elongated element 110 and element 102 can be increased (up to a maximum of a ninety degree angle) to increase the height of first elongated element 110 to match the height of collar strip 304. Likewise, the acute angle between the first elongated element 110 and element 102 can be decreased to decrease the height of first elongated element 110 to match the height of collar strip 304. In a similar thread, the acute angle between the second elongated element 112 and element 102 can be increased to increase the height of second elongated element 112 and the acute angle between the second elongated element 112 and element 102 can be decreased to decrease the height of second elongated element 112. In this embodiment, first and second elongated elements 110, 112 possess adjustable joints to element 102 that allow the angle between the first and second elongated elements 110, 112 and element 102 to be adjusted manually to a set angle. Once adjusted for a given shirt, the position of apparatus 100 within the shirt collar 310 is fixed and immobile and maintains the optimal shirt collar position irrespective of the movement of the shirt wearer. Still, apparatus 100 remains concealed by the shirt collar 310.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

The invention claimed is:

1. An apparatus designed to operate with a shirt collar so as to provide stiffness to the shirt collar, the apparatus consisting of:

a circular, semi-rigid element for surrounding the shirt collar, wherein the semi-rigid element is coextensive with the shirt collar and includes a gap located at a placket of a shirt and wherein the semi-rigid element contacts an interior of a collar fold of the shirt collar;

a first elongated element coupled to a left side of the semi-rigid element at a first distance from a left end of the semi-rigid element, wherein the first elongated element projects downwards at an acute angle from the left side towards a center point of the semi-rigid element and projects downwards at an acute angle towards the left end of the semi-rigid element, and wherein a flat bottom end of the first elongated element contacts a shoulder of the shirt;

a second elongated element coupled to a right side of the semi-rigid element at a second distance from a right end of the semi-rigid element, wherein the second distance is equal to the first distance, and wherein the second elongated element projects downwards at an acute angle from the right side towards the center point of the semi-rigid element and projects downwards at an acute angle towards the right end of the semi-rigid element, and wherein a flat bottom end of the second elongated element contacts a shoulder of the shirt;

wherein a juncture of the first elongated element and the semi-rigid element comprises an adjustable joint wherein the acute angles of the first elongated element are adjustable; and wherein a juncture of the second elongated element and the semi-rigid element comprises an adjustable joint wherein the acute angles of the second elongated element are adjustable.

2. The apparatus of claim 1, wherein the semi-rigid element comprises a metallic interior surrounded by a rubber composite exterior.

3. The apparatus of claim 2, wherein the first and second elongated elements comprise a metallic interior integrally formed with the semi-rigid element.

4. The apparatus of claim 3, wherein the first and second elongated elements comprise a rubber composite exterior integrally formed with the rubber composite exterior of the semi-rigid element.

5. The apparatus of claim 1, wherein the semi-rigid element comprises a plastic interior surrounded by a rubber composite exterior.

6. The apparatus of claim 5, wherein the first and second elongated elements comprise a plastic interior integrally formed with the semi-rigid element.

7. The apparatus of claim 6, wherein the first and second elongated elements comprise a rubber composite exterior integrally formed with the rubber composite exterior of the semi-rigid element.

8. The apparatus of claim 1, further comprising a rubber tip for covering a first end of the semi-rigid element.

9. The apparatus of claim 8, wherein the rubber tip comprises a strip that is wrapped around the first end of the semi-rigid element.

10. The apparatus of claim 8, further comprising a rubber tip for covering a second end of the semi-rigid element.

11. An apparatus designed to operate with a shirt collar so as to provide stiffness to the shirt collar, the apparatus consisting of:

a circular, semi-rigid element for surrounding in interior fold of the shirt collar, wherein the semi-rigid element is coextensive with the shirt collar and includes a gap located at a placket of a shirt and wherein the semi-rigid element contacts an interior of a collar fold of the shirt collar;

a first elongated element coupled to a left side of the semi-rigid element at a first distance from a left end of the semi-rigid element, wherein the first elongated element projects downwards at an acute angle from the left side of the semi-rigid element towards a center point of the semi-rigid element and projects downwards at an acute angle towards the left end of the semi-rigid element, and wherein a flat bottom end of the first elongated element contacts a left shoulder of the shirt;

a second elongated element coupled to a right side of the semi-rigid element at a second distance from a right end of the semi-rigid element, wherein the second distance is equal to the first distance, and wherein the second elongated element projects downwards at an acute angle from the right side of the semi-rigid element towards the center point of the semi-rigid element and projects downwards at an acute angle towards the right end of the semi-rigid element, and wherein a flat bottom end of the second elongated element contacts a right shoulder of the shirt, wherein the semi-rigid element and the first and second elongated elements are integrally formed of a single piece of material; and a bulbous rubber element located at a left end of the semi-rigid element and a bulbous rubber element located at a right end of the semi-rigid element.

12. The apparatus of claim 11, wherein the semi-rigid element and the first and second elongated elements comprise a metallic interior.

13. The apparatus of claim 12, wherein the semi-rigid element and the first and second elongated elements are surrounded by a rubber composite exterior.

14. The apparatus of claim 11, wherein the semi-rigid element and the first and second elongated elements comprise a plastic interior.

15. The apparatus of claim 14, wherein the semi-rigid element and the first and second elongated elements are surrounded by a rubber composite exterior.

16. A collared shirt including a stiffened shirt collar, comprising an apparatus designed to operate with the shirt collar so as to provide stiffness to the shirt collar, the apparatus consisting of:

a circular, semi-rigid element for surrounding an interior fold of the shirt collar, wherein the semi-rigid element is coextensive with the shirt collar and includes a gap located at a placket of the shirt and wherein the semi-rigid element contacts an interior of a collar fold of the shirt collar;

a first elongated element coupled to a left side of the semi-rigid element at a first distance from a left end of the semi-rigid element, wherein the first elongated element projects downwards at an acute angle from the left side of the semi-rigid element towards a center point of the semi-rigid element and projects downwards at an acute angle towards the left end of the semi-rigid element, and wherein a flat bottom end of the first elongated element contacts a left shoulder of the shirt; and a second elongated element coupled to a right side of the semi-rigid element at a second distance from a right end of the semi-rigid element, wherein the second distance is equal to the first distance, and wherein the second elongated element projects downwards at an acute angle from the right side of the semi-rigid element towards the center point of the semi-rigid element and projects downwards at an acute angle towards the right end of the semi-rigid element, and wherein a flat bottom end of the second elongated element contacts a right shoulder of the shirt, wherein the semi-rigid element and the first and second elongated elements are integrally formed of a single piece of material.

* * * * *